US005404947A

United States Patent [19]

Sorem et al.

[11] Patent Number: 5,404,947

[45] Date of Patent: Apr. 11, 1995

[54] PRE-FORMED STRESS RINGS FOR INFLATABLE PACKERS

[75] Inventors: Robert M. Sorem, Sugar Land, Tex.; David M. Eslinger, Broken Arrow, Okla.

[73] Assignee: Dowell Schlumberger Incorporated, Sugar Land, Tex.

[21] Appl. No.: 128,351

[22] Filed: Sep. 28, 1993

[51] Int. Cl.[6] ..... E21B 33/127

[52] U.S. Cl. ..... 166/187; 277/34; 166/195

[58] Field of Search ..... 166/187; 277/34

[56] References Cited

U.S. PATENT DOCUMENTS 2,717,644 9/1955 Bell et al. ..... 166/187
3,524,503 8/1970 Baker ..... 166/187
3,889,749 6/1975 Hutchison ..... 166/187
4,768,590 9/1988 Sanford et al. ..... 166/187
4,923,007 5/1990 Sanford et al. ..... 166/187

*Primary Examiner*—Ramon S. Britts
*Assistant Examiner*—Frank S. Tsay
*Attorney, Agent, or Firm*—Stephen A. Littlefield

[57] ABSTRACT

An inflatable packer apparatus for use in a well bore has pre-formed metal stress rings surrounding the respective opposite end portions of the packer element. The stress rings are machined to initially have conical outer surfaces, and then are outwardly stressed beyond their yield strengths to obtain plastic deformation such that such outer surfaces are generally cylindrical so that the packer element can be inflated to higher pressures.

4 Claims, 2 Drawing Sheets

PRE-FORMED STRESS RINGS FOR INFLATABLE PACKERS

FIELD OF THE INVENTION

This invention relates generally to inflatable packers that are used to bridge a well bore or to isolate a zone therein, and particularly to uniquely formed stress rings which surround end portions of the inflatable packer element and permit inflation to higher maximum pressure differential without downhole failure.

BACKGROUND OF THE INVENTION

Inflatable packers are used in the oil industry to bridge a well bore or to isolate a zone therein. A typical inflatable packer has a tubular mandrel or body that carries an elongated inner elastomeric sleeve which is surrounded by a layer of protective armor such as overlapped slats, reverse-layed cables, or woven composite constructions including cables or wires in an elastomer matrix. An outer elastomer seal sleeve surrounds all or a portion of the armor layer, so that when fluid under pressure is supplied to the inside of the inner elastomer sleeve member, this sleeve member, the armor layer and the outer elastomer seal sleeve are expanded. The outer sleeve engages the well bore wall to provide a pack-off, and any uncovered portion of the armor also engages the well bore wall to provide additional frictional resistance to longitudinal movement.

The opposite end portions of the armor layer and the inner elastomer sleeve are surrounded by stress rings which are the principle :radial load-bearing members of the end fittings which attach these elements to the mandrel. Such stress rings often are the limiting factors in terms of maximum pressure differentials to which the inflatable packer assembly can be subjected. If a stress ring cracks and fails downhole, the packer assembly also is likely to rupture and fail also. Moreover, a stress ring may be permanently deformed to the extent that the packer cannot be retrieved from the well through production tubing through which the packer was initially run into the well.

A general object of the present invention is to provide an inflatable packer apparatus having new and improved stress rings which enable the packer element to be inflated to higher pressure differentials without damage to the stress rings at the opposite end thereof.

SUMMARY OF THE INVENTION

This and other objects are attained in accordance with the concepts of the present invention through the provision of stress rings for an inflatable packer element which are preloaded until the high stress zones thereof have yielded so that a portion of the load is transmitted to lower stress areas of the ring, and so that the packer subsequently can be cycled to higher pressures than previously possible without further stress ring yielding. In a preferred embodiment, the outer diameter of a stress ring is machined, for example, with a tapered or radiused outer surface so that the final shape of such outer surface after pre-forming is cylindrical. The pre-yielding then is accomplished by means such as a tapered swage mandrel that is driven inside the ring. A stress ring so formed has increased resistance to crack formation and propagation as the packer element is inflated, and has a higher effective load rating.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
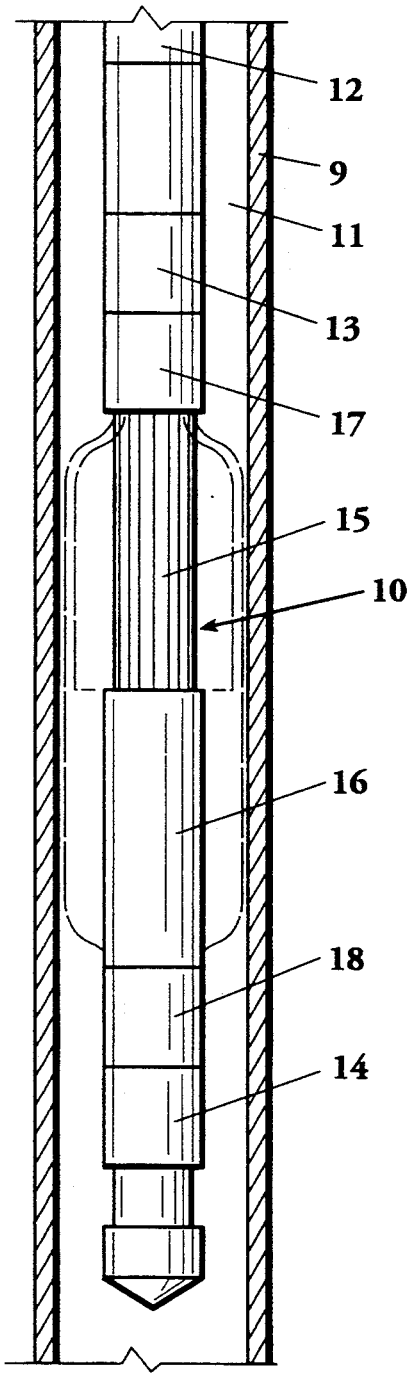
FIG. 1 is a schematic view of an inflatable packer suspended in a well bore on a running string.

Referring initially to FIG. 1, an inflatable packer assembly indicated generally at 10 is shown suspended in a well bore 11 on a running string 12 of jointed or coiled tubing. In some cases the packer 10 may be run on wireline in combination with an appropriate inflation pressure generating setting tool. The packer assembly 10 includes a central tubular body or mandrel that carrier upper and lower collars 13, 14 within which the respective opposite end portions of an inner elastomeric sleeve and a protective armor means 15 for such sleeve are anchored. An outer elastomeric seal sleeve 16 covers all or a part of the length of the armor means 15, and sealingly engages the surrounding wall of the well bore 11 when the inner sleeve, the armor means 15 and such outer seal sleeve are expanded by fluid under pressure that is applied to the interior of the inner elastomer sleeve member. The armor means 15 can take various forms, for example a plurality of longitudinally extending, circumferentially overlapping slats, reverse-layed cables, or a woven composite of cables or wires in an elastomer matrix. The outer seal sleeve 16 can be bonded to outer surface areas of the armor means 15, if desired. Stress rings 17 and 18 are mounted adjacent the collars 13, 14 and surround the underlying end portions of the armor means 15.

Figure 2:
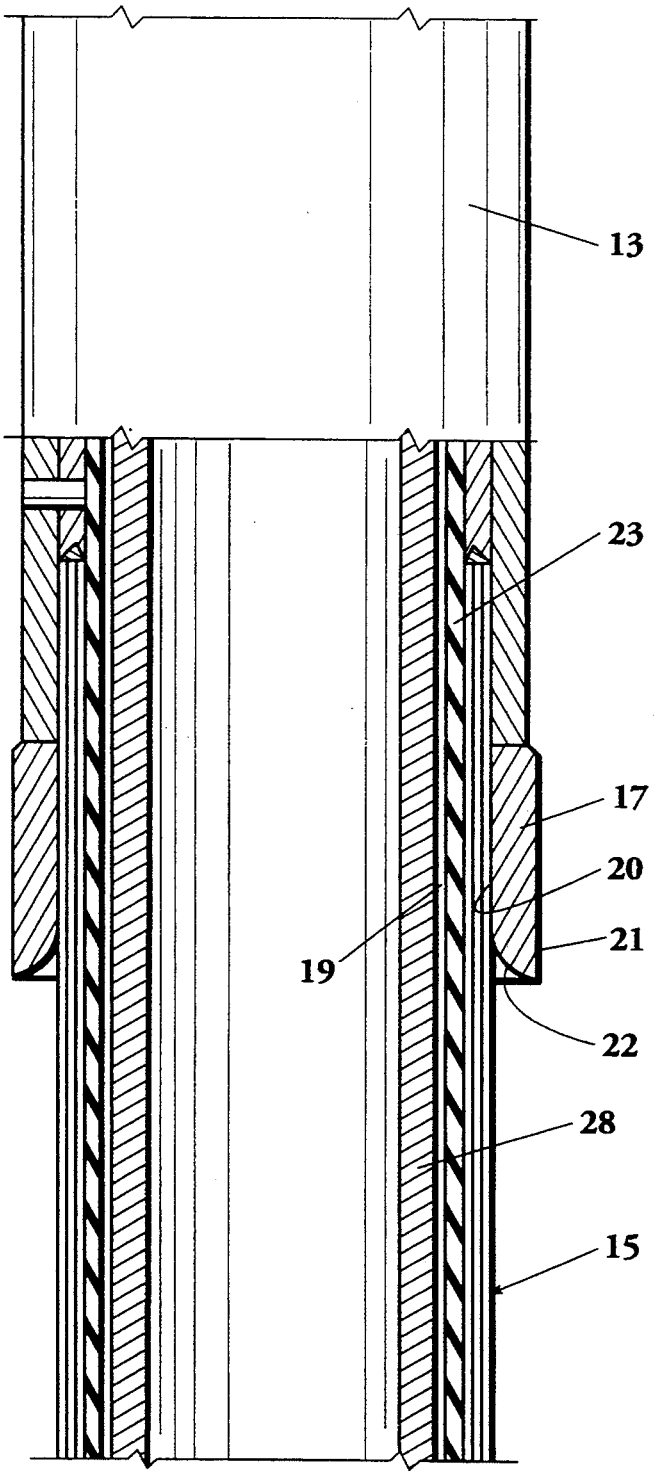
FIG. 2 is a longitudinal sectional view of the upper stress ring and associated packer components of the assembly shown in FIG. 1.
Figure 3:
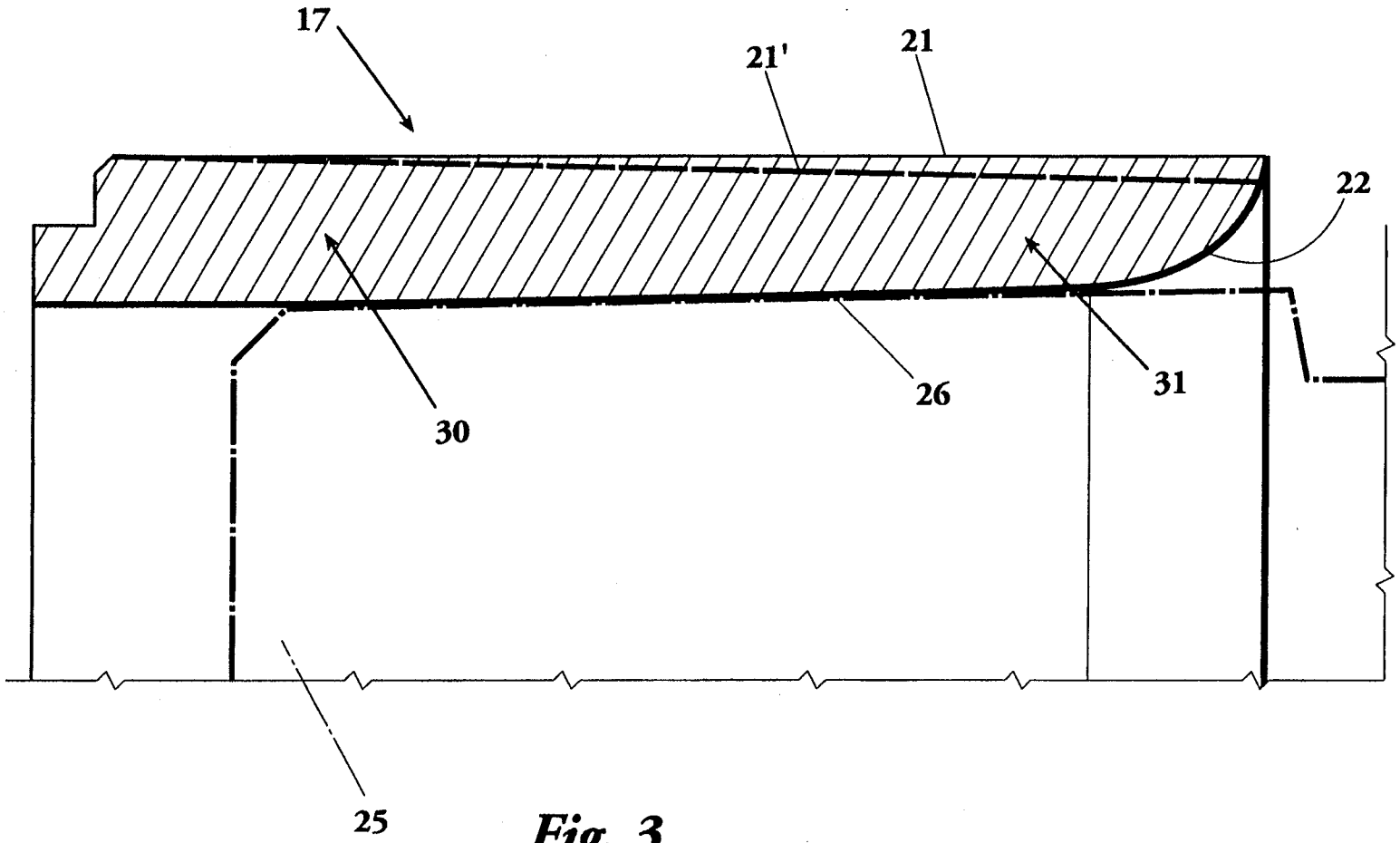
FIG. 3 is a quarter sectional view showing the stress ring configuration before and after preforming in accordance with this invention.

As shown in FIG. 2, a metal stress ring 17 in accordance with the present invention has a generally tubular form with an inner surface 20, an outer surface 21, and an outwardly flared outer end surface 22. The flared surface 22 functions to define the bending radius of the armor means 15 as the inner elastomer sleeve 23 is inflated. Prior to pre-forming the ring 17, the outer surface 21' thereof is machined to provide a slightly frustoconical or radiused shape as shown by dash lines in FIG. 3, with the original outer surface 21 being shown in solid line. The slope of the tapered surface 21' is such that after pre-forming, the outer surface is again cylindrical. The loading by which deformation of the ring 17 is accomplished can be performed in several ways, for example by a swage mandrel 25 shown in dash-dot-dash lines and having a tapered outer surface 26 that is driven or pressed into the bore of the stress ring 17. A large part of the length of the ring 17 thus is deformed well into the plastic region so that the outer surface 21 as noted above, again is substantially cylindrical. Although further machining to either the inner or outer diameter of the ring 17 can be done to obtain prescribed dimensions, such further machining is not recommended since the desired stress distribution may be changed. The finished form of the cross-section of the stress ring 17 is shown in FIG. 3, with the dash-dot-dash line 26 defining the inner wall surface and the solid line 21 defining the outer wall surface. The lower stress ring 18 is pre-formed in the same manner so that it is the inverted or mirror image of the upper ring 17.

OPERATION

The inflatable packer 10 having the stress rings 17, 18 formed in accordance with this invention is lowered with the well bore 11 on the running string 12 to a depth where the packer is to be set. The well bore 11 can be lined with casing 9, or can be uncased (open-hole). Fluids under pressure are pumped into the running string 12 at the surface which causes pressure to be applied through the annular space 19 outside the mandrel 28 to the inner walls of the elastomer sleeve 23. The sleeve 23 expands, which causes concurrent expansion of the armor means 15 and the outer seal sleeve 16 until its outer surface sealingly engages the surrounding well bore wall as shown by phantom lines in FIG. 1. The exposed portion, if any, of the armor means 15 also is pressed against the well wall to provide a frictional anchor against longitudinal movement.

The upper and lower stress rings 17 and 18 will have been pre-formed in the manner described above such that high stress zones thereof have already yielded. This method of manufacture achieves several desirable results: 1) a portion of the load imparted to each ring by the underlying portion of the armor means 15 is transmitted to lower stress regions 30, and 2) the packer assembly 10 can be cyclically inflated to higher pressures than previously possible without further yielding of the stress ring regions 31. These features significantly increase the service pressure rating of the packer assembly 10. For example it can be demonstrated that for a 3 inch o.d. inflatable packer assembly, a standard metal stress ring which has not been preformed as disclosed herein has a yield pressure of about 3500 psi. At about 3700 psi the ring plastically deforms substantially and will continue to grow outward with each pressure cycle applied thereto. The rings 17 and 18 are pre-formed to an equivalent pressure of about 4300 psi. The improved packer assembly 10 then can be pressure-cycled to about 4000 psi for at least ten cycles without any significant additional plastic deformation of the ring members 17, 18.

It now will be recognized that an inflatable packer apparatus having new and improved pre-formed stress rings has been disclosed. Since certain changes or modifications may be made in the disclosed embodiment without departing from the inventive concepts involved, it is the aim of the appended claims to cover all such changes and modifications falling within the true spirit and scope of the present invention.

What is claimed is:

1. In an inflatable well packer apparatus having a tubular body which carries an inner elastomer sleeve member, armor means surrounding said inner sleeve member, said armor means having opposite end portions, and an outer elastomer sleeve member covering at least a portion of said armor means, the improvement comprising, in combination: a metal stress ring surrounding each of said end portions of said armor means and confining each of said end portions as said sleeve member and armor means are expanded, each of said stress rings being pre-formed in a manner such that regions thereof have been outwardly stressed beyond its yield strength to obtain a preselected amount of plastic deformation thereof.

2. The apparatus of claim 1 wherein each of said stress rings is machined to have a tapered outer surface that becomes cylindrical when said pre-forming is accomplished.

3. The apparatus of claim 2 wherein each of said stress rings has an outwardly flared outer end surface.

4. A stress ring for use in confining the end portion of an inflatable packer element, comprising: a generally tubular metal ring member having an inner bore sized to fit closely around said end portion, said ring member having an inner end and an outer end into which said end portion extends; said ring member initially having an outer surface that tapers inward toward said outer end; and a substantial portion of the length of said ring member from said outer end being outwardly stressed beyond its yield strength to obtain plastic deformation thereof in a manner such that said outer surface then is substantially cylindrical.

* * * * *